US011503883B1

(12) United States Patent
Bray

(10) Patent No.: US 11,503,883 B1
(45) Date of Patent: Nov. 22, 2022

(54) BAND ACCESSORY

(71) Applicant: 3B International Pty Ltd., Camden (AU)

(72) Inventor: Jeff Anthony Bray, Camden (AU)

(73) Assignee: 3B International Pty Ltd, Camden (AU)

( * ) Notice: Subject to any disclaimer, the term of this patent is extended or adjusted under 35 U.S.C. 154(b) by 453 days.

(21) Appl. No.: 16/875,716

(22) Filed: May 15, 2020

(51) Int. Cl.
*A44C 5/00* (2006.01)

(52) U.S. Cl.
CPC ..... *A44C 5/0007* (2013.01); *A44C 5/0053* (2013.01)

(58) Field of Classification Search
CPC ... A45C 5/0007; A45C 5/0015; A45C 5/0023; A45C 5/003; A45C 5/0038; A45C 5/0046; A45C 5/0053
See application file for complete search history.

(56) References Cited

U.S. PATENT DOCUMENTS

| | | | | |
|---|---|---|---|---|
| 3,340,630 | A * | 9/1967 | Becker | G09D 3/10 63/3 |
| 3,766,674 | A * | 10/1973 | Bersche | G04B 47/003 40/113 |
| 5,640,857 | A * | 6/1997 | Halik | A44C 17/02 63/21 |
| 9,462,855 | B1 * | 10/2016 | Curran | A44C 15/004 |
| 10,995,885 | B2 * | 5/2021 | Morton | F16B 21/06 |
| 2014/0101894 | A1 * | 4/2014 | Parascandolo | A44C 5/18 24/3.2 |

* cited by examiner

*Primary Examiner* — Corey N Skurdal
(74) *Attorney, Agent, or Firm* — Eric Karich; Karich & Associates

(57) ABSTRACT

A band accessory includes a first accessory component and a second accessory component which slidably engage each other for attachment to a wearable band. The accessory components each include an upper strip and a lower strip that are laterally spaced by a connector strip. The first upper strip has a top surface that includes a decorative feature. An upper track groove is formed in one of the accessory components, and a rail is formed in the other accessory component, such that the upper rail slidably engages the upper track groove. At least one magnet on the first and/or second accessory components secures the first and second accessory components in the closed position.

16 Claims, 3 Drawing Sheets

BAND ACCESSORY

BACKGROUND OF THE INVENTION

Field of the Invention

This invention relates generally to band accessories, and more particularly to a wristband accessory that includes two components which engage each other to form a decorative ring around the wristband for personalizing a watch, bracelet, collar, etc.

Description of Related Art

It is common to add different decorative accessories to a watchband to personalize a watch to a particular person. One common accessory is in the form of a ring that is slidably mounted onto a watch band. The disadvantage of the ring shaped accessory is that it cannot be adjusted for different sizes of watch bands.

There is a long-felt need for a wristband accessory that facilitates rapid and easy adjustment of the wristband accessory to wristbands of different sizes and thicknesses.

SUMMARY OF THE INVENTION

The present invention teaches certain benefits in construction and use which give rise to the objectives described below.

The present invention provides a band accessory that includes a first accessory component and a second accessory component which slidably engage each other for attachment to the band. The accessory components each include an upper strip and a lower strip that are laterally spaced by a connector strip. The first upper strip has a top surface that includes a decorative feature. An upper track groove is formed in one of the accessory components, and a rail is formed in the other accessory component, such that the upper rail slidably engages the upper track groove. At least one magnet on the first and/or second accessory components secures the first and second accessory components in the closed position.

In one embodiment, the band accessory includes a first accessory component and a second accessory component which slidably engage each other for attachment to a wristband. The first accessory component has a first upper strip and a first lower strip that are laterally spaced by a first middle connector strip such that the first upper strip and the first lower strip are positioned substantially parallel to each other. The first upper strip has a top surface that includes a decorative feature. The second accessory component has a second upper strip and a second lower strip that are laterally spaced by a second middle connector strip such that the second upper strip and the second lower strip are positioned substantially parallel to each other.

In one embodiment, an upper track groove is formed in the second upper strip of the second accessory component, and a upper rail is formed on a bottom surface of the first upper strip of the first accessory component, such that the upper rail slidably engages the upper track groove such that the first and second accessory components are able to slide longitudinally between an open position wherein the first and second accessory components are separate from each other, and a closed position wherein the first and second accessory components together form an annular shape that is adapted to surround the band so that the decorative feature is displayed outwardly. At least one magnet on the first and/or second accessory components secures the first and second accessory components in the closed position.

A primary objective of the present invention is to provide a band accessory having advantages not taught by the prior art.

Another objective is to provide a band accessory that may be adjusted to fit securely on bands of different sizes.

A further objective is to provide a band accessory that is easy to install, and remains securely in place while being worn.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a band accessory 10, in this embodiment a wristband accessory for attachment to a wristband 14 of a watch 12. While an exemplary type of band is described herein, the band accessory 10 may be attached to a variety of wearable bands, e.g., a bracelet, dog collar, belt, etc., or any other type of band which may receive the band accessory 10.

Figure 1:
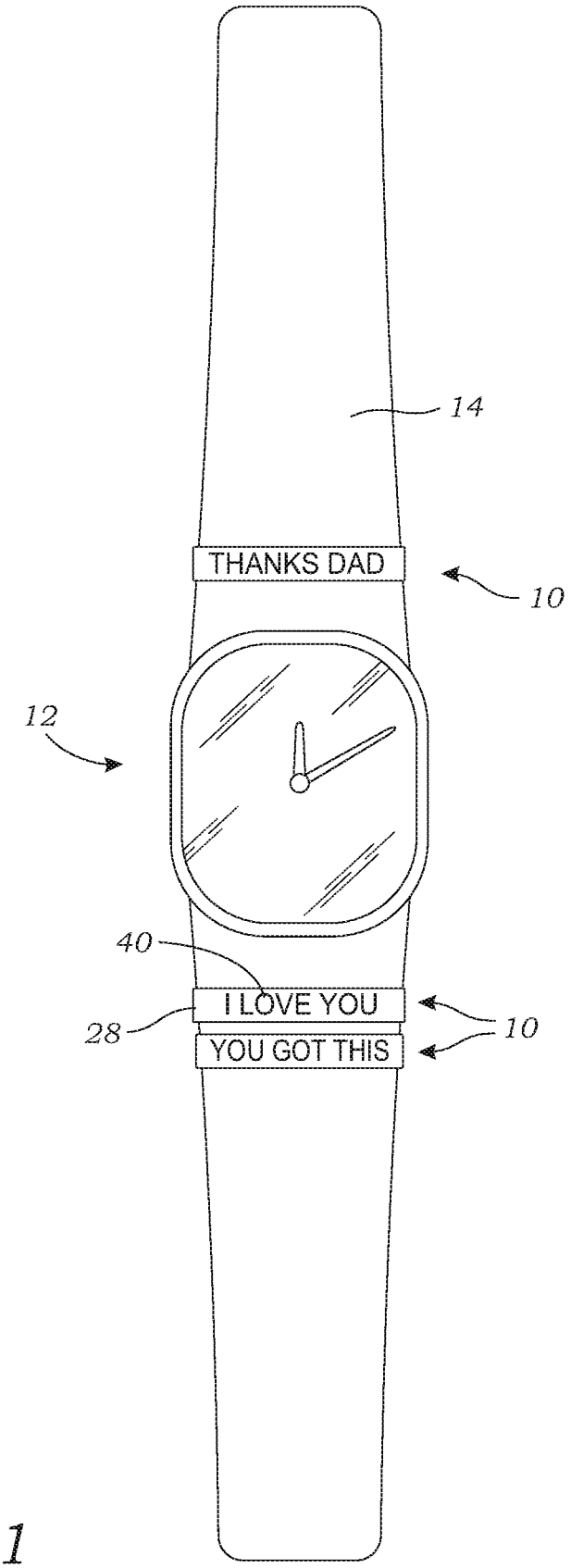
FIG. 1 is a perspective view of a watch illustrating several wristband accessories mounted thereupon, according to one embodiment of the present invention.

FIG. 1 is a perspective view of the watch 12, illustrating several of the wristband accessories 10 mounted on the wristband 14 according to one embodiment of the present invention. As shown in FIG. 1, the wristband accessories 10 attach around the wristband 14 for adorning the watch 12, and can display a decorative feature 40 on a top surface 28, as discussed in greater detail below. In this embodiment, the decorative feature 40 includes text etched, embossed, printed, or otherwise formed or displayed on the top surface 28. The text may be encouraging names, slogans, phrases, reminders, messages, etc. In other embodiments, the decorative feature 40 may include a drawing, design, or graphic, and/or crystals, jewels and other decorative elements known in the art. In some embodiments, the decorative feature 40 may be displayed on other or multiple surfaces of the accessory 10, e.g., on a bottom surface 45, described in greater detail below.

Figure 2:
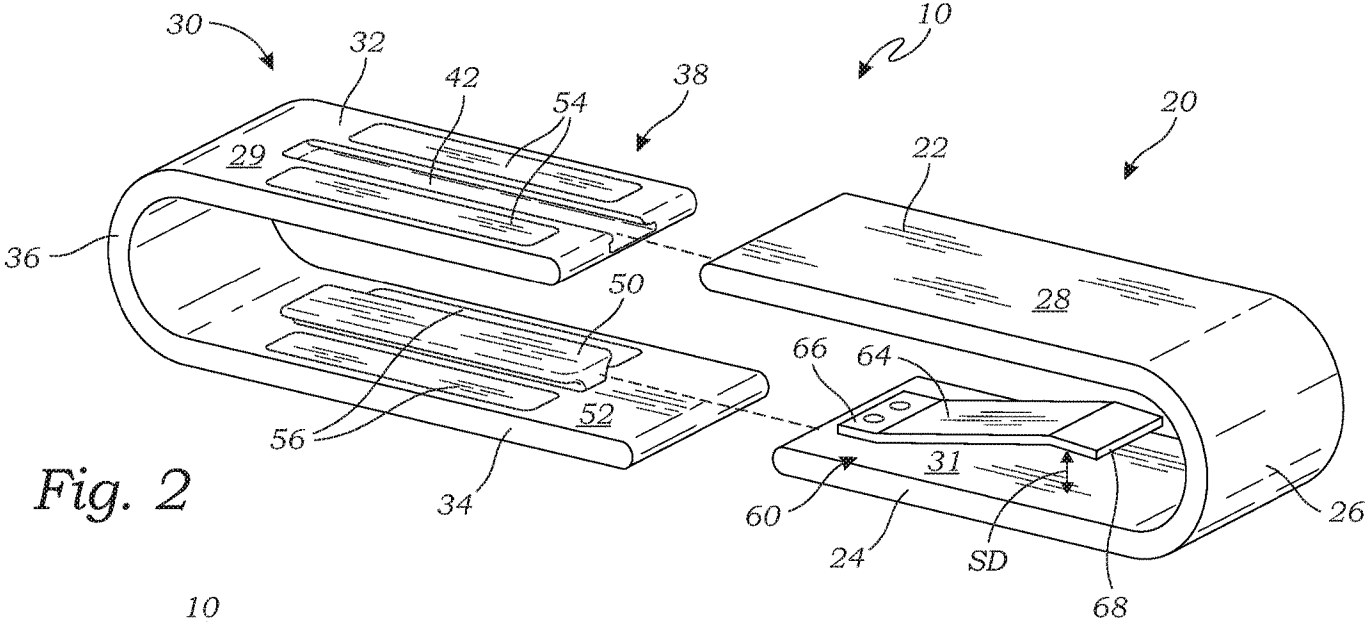
FIG. 2 is an exploded top perspective view of one of the wristband accessories.
Figure 3:
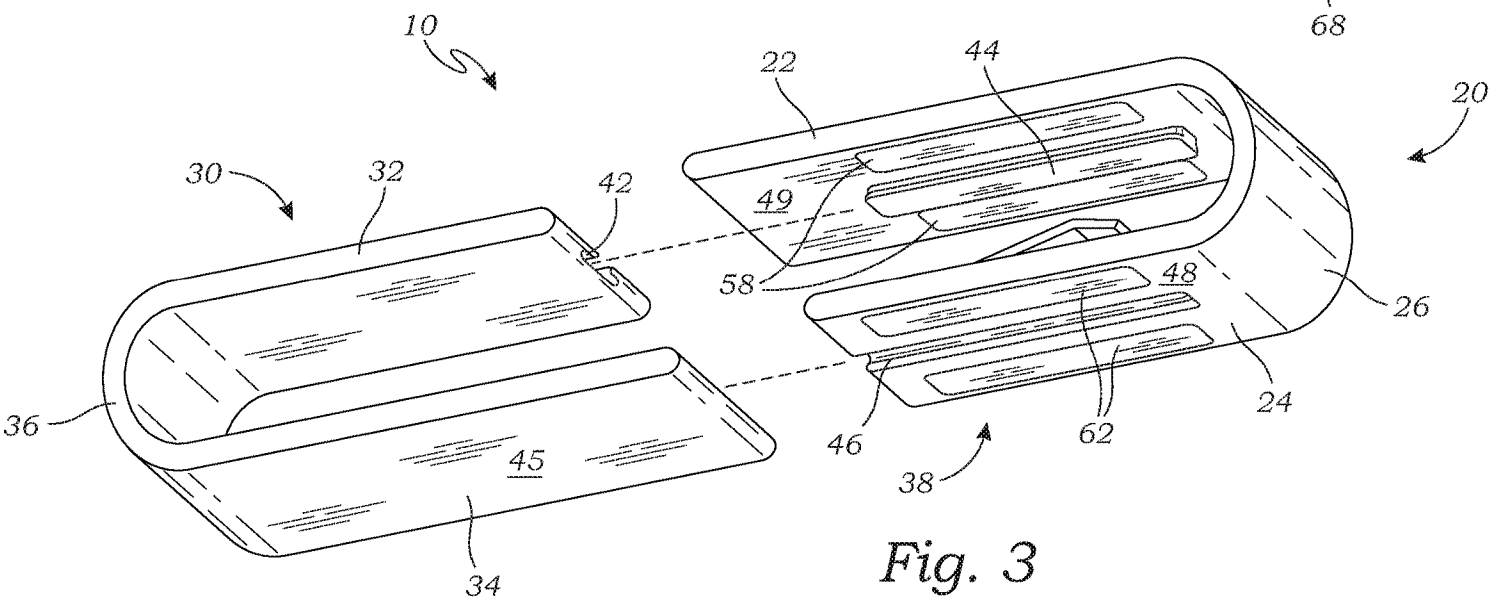
FIG. 3 is an exploded bottom perspective view thereof.

FIG. 2 is an exploded top perspective view of one of the wristband accessories; and FIG. 3 is an exploded bottom perspective view thereof. As shown in FIGS. 2-3, the wristband accessory 10 includes a first accessory component 20 and a second accessory component 30 which slidably engage each other for attachment to the wristband 14 of the watch 12.

The accessory components 20 and 30 each include an upper strip 22 and 32, and a lower strip 24 and 34, respectively. In this embodiment, the first accessory component 20 is laterally spaced by a first middle connector strip 26 such that the first upper strip 22 and the first lower strip 24 are positioned substantially parallel to each other, and the second accessory component 30 is laterally spaced by a second middle connector strip 36 such that the second upper strip 32 and the second lower strip 34 are positioned substantially parallel to each other.

The first upper strip 22 has the top surface 28 that includes the decorative feature 40, which is shown in FIG. 1, and the second lower strip 34 has the bottom surface 45 described above. The wristband accessory 10 includes a means for interlocking 38 the first and second accessory components 20 and 30 so that they slide longitudinally between an open position wherein the first and second accessory components 20 and 30 are separate from each other, and a closed position wherein the first and second accessory components 20 and 30 together form an annular shape that is adapted to surround the wristband 14 of the watch 12 so that the decorative feature 40 is displayed on the wristband 14.

The means for interlocking 38 the first and second accessory components 20 and 30 of this embodiment may include an upper track groove 42 formed in one of the accessory components, and an upper rail 44 formed in the other accessory component, such that the upper rail 44 slidably engages the upper track groove 42. In this embodiment, the upper rail 44 and the upper track groove 42 are generally "T" shaped in construction, but in other embodiments may be formed in rounded, tapering, or other suitable shapes.

In this embodiment, the means for interlocking 38 further includes at least one magnet for interlocking the two components 20 and 30, in this embodiment a plurality of magnets 54, 56, 58, & 62, on the first and/or second accessory components 20 and 30. These magnets secure the first and second accessory components 20 and 30 in the closed position, as discussed below.

As shown in FIGS. 2-3, in this embodiment, the means for interlocking 38 includes the upper track groove 42 formed in the second upper strip 32, and the upper rail 44 formed on a bottom surface 49 of the first upper strip 22, the upper rail 44 being sized and shaped to slidably engage the upper track groove 42. In this embodiment, the means for interlocking 38 further includes a lower track groove 46 formed in a bottom surface 48 of the first lower strip 24, and a lower rail 50 formed on a top surface 52 of the second lower strip 34, the lower rail 50 being sized and shaped to slidably engage the lower track groove 46.

In this embodiment, the wristband accessory 10 further includes a top pair of magnets 54 which are disposed on a top surface 29 of the second upper strip 32, on opposite sides of the upper track groove 42, and a bottom pair of magnets 56 which are disposed on the top surface 52 of the second lower strip 34, on opposite sides of the lower rail 50. An upper pair of magnets 58 are further disposed on the bottom surface 49 of the first upper strip 22, on opposite sides of the upper rail 44, and a lower pair of magnets 62 are disposed on the bottom surface 48 of the first lower strip 24, on opposite sides of the lower track groove 46. However, in other embodiments, there may be only one magnet or pair of magnets, which magnetically attach to a surface on the opposing accessory component, such as a strip of metal or the wristband accessory 10 itself. In this embodiment, all of the magnets 54, 56, 58, & 62 are in the form of elongate strips running lengthwise along the wristband accessory 10, but in other embodiments, may be any shape deemed suitable by one skilled in the art (e.g., round, irregular, etc.).

The combination of the rails/grooves and the magnets allow the wristband accessory 10 to adjust to accommodate various wristband widths. In some embodiments, the wristband accessory 10 is able to slide between 18-24 mm, and may accommodate a range of band thickness between 2-5 mm. Other features may be included to allow a snug and secure fit of the wristband accessory 10 on the wristband 14, shown in FIGS. 4-6 and discussed below.

While the illustrated embodiment includes two sets of rail/groove features, in another embodiment, only one may be used. Furthermore, the means for interlocking 38 may alternatively include other forms of engaging elements which interlock in an equivalent manner, such as interlocking side edges (not shown), or other structures known in the art. Furthermore, rather than magnets, alternative forms of fasteners, clasps, or other mechanical or non-mechanical fasteners may be used. For example, in a more permanent version, an adhesive might be used, or any forms of hooks, snaps, clasps, spring loaded pins, etc.

Figure 4:
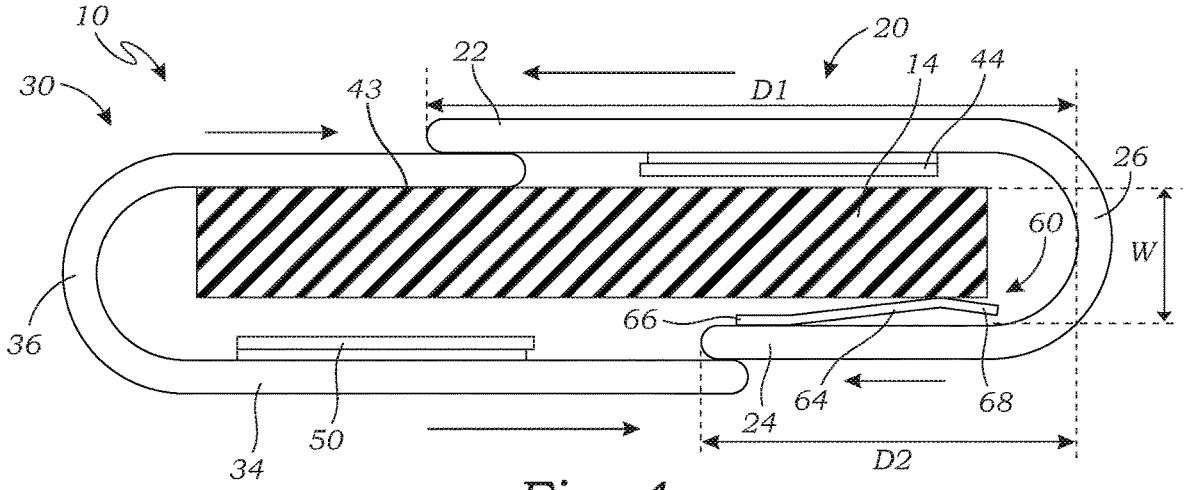
FIG. 4 is a side elevational view thereof.

FIG. 4 is a sectional view of the wristband accessory 10. As shown in FIG. 4, in some embodiments, the first upper strip 22 extends a first distance D1 from the first middle connector strip 26 that is different than a second distance D2 that the first lower strip 24 extends from the first middle connector strip 26. In this embodiment, the a first distance D1 is different than the second distance D2, in this embodiment it is greater than the second distance D2.

As shown in FIG. 4, a bottom surface 43 of the second upper strip 32 and the top surface 31 of the first lower strip 24 are spaced a width W apart. This width W is selected to accommodate the wristband 14, and in this embodiment is 2-5 mm; however, those skilled in the art may select dimensions that are best suited for the purposes of their product, and such alternatives should be considered within the scope of the present invention.

In the embodiment of FIG. 4, the wristband accessory 10 includes a means for frictionally engaging 60 the wristband 14. In this embodiment, the means for frictionally engaging 60 is in the form of a flat spring 64 extending from a proximal end 66 to a distal end 68, the proximal end 66 being attached to the top surface 31 of the first lower strip 24 of the first accessory component 20. As shown in FIG. 2, the distal end 68 is biased away from the top surface 31 of the first lower strip 24 towards a position that is spaced a distance SD (shown in FIG. 1) from the top surface 31 of the first lower strip 24. In use, the wristband 14 may slide over the flat spring 64, the wristband 14 pushing the distal end 68 downwardly, wherein the flat spring 64 is resilient enough to press against the wristband 14 to secure the wristband accessory 10 in place. In some embodiments, there is a second flat spring on extending from the bottom surface 49 of the first upper strip 22 (not shown). Other forms of the means for frictionally engaging 60 are shown in FIGS. 5 and 6, and discussed below.

Figure 5:
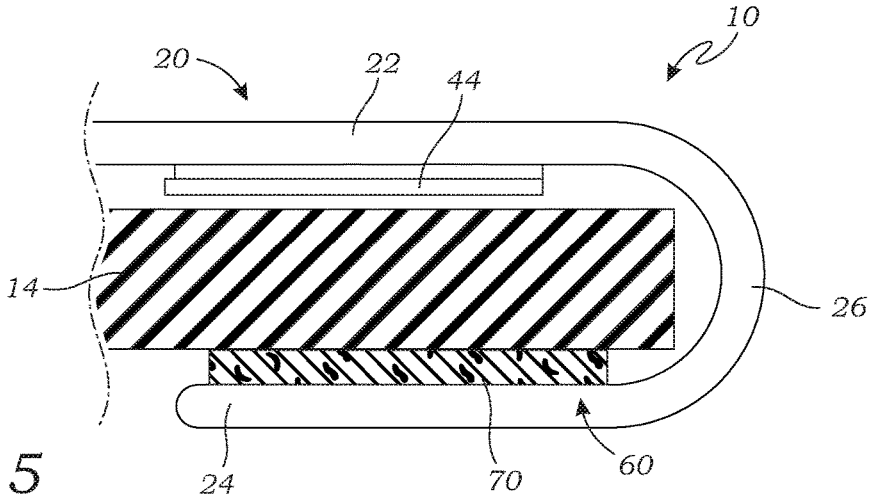
FIG. 5 is a side elevational view of a portion of a second embodiment of the accessory.

FIG. 5 is a sectional view of the wristband accessory 10, showing an alternative means for frictionally engaging 60 the wristband 14. In this embodiment, the means for frictionally engaging 60 may include a resilient sheet 70 sized to be mounted on the top surface 31 of the first lower strip 24, the resilient sheet having a thickness suitable for causing suitable frictional engagement, as shown.

Figure 6:
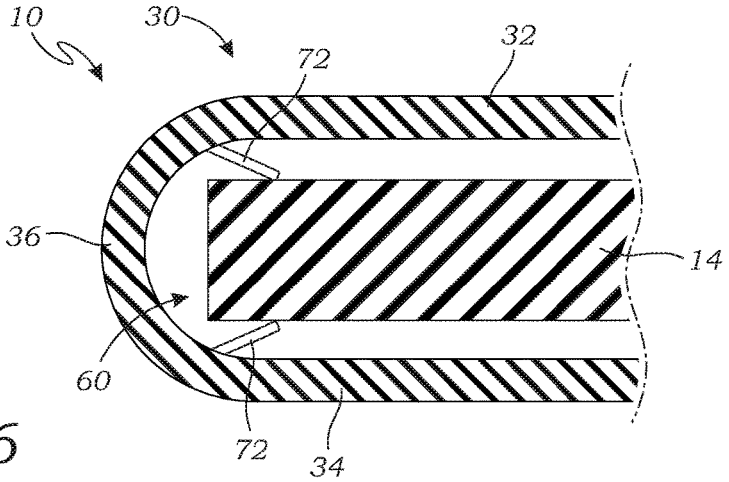
FIG. 6 is a side elevational view of a portion of a third embodiment of the accessory.

FIG. 6 is a sectional view of the wristband accessory 10, showing another means for frictionally engaging 60 the wristband 14. In this embodiment, the means 60 for frictional engagement may include a pair of prongs 72 extending from the second accessory component 30 for abutting the wristband 14. While some embodiments of the means for frictionally engaging 60 are illustrated, those skilled in the art may devise alternative structures that are similar or equivalent, and such alternatives should be considered within the scope of the present invention.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A band accessory comprising:

a first accessory component and a second accessory component which slidably engage each other for attachment to a wearable band;

wherein the first and second accessory components each include an upper strip and a lower strip that are laterally spaced by a connector strip;

wherein the first upper strip has a top surface that includes a decorative feature;

an upper track groove formed in one of the first or second accessory components, and an upper rail is formed in the other of the accessory components, such that the upper rail slidably engages the upper track groove; and at least one magnet on the first and/or second accessory components to secure the first and second accessory components in a closed position.

2. A band accessory for attachment to a wearable band, comprising:

a first accessory component having a first upper strip and a first lower strip that are laterally spaced by a first middle connector strip such that the first upper strip and the first lower strip are positioned substantially parallel to each other;

the first upper strip having a top surface that includes a decorative feature;

a second accessory component having a second upper strip and a second lower strip that are laterally spaced by a second middle connector strip such that the second upper strip and the second lower strip are positioned substantially parallel to each other;

a means for interlocking the first and second accessory components so that they slide longitudinally between an open position wherein the first and second accessory components are separate from each other, and a closed position wherein the first and second accessory components together form an annular shape that is adapted to surround the wearable band so that the decorative feature is displayed on the wearable band; and at least one magnet on either of the first or second accessory components, for securing the first and second accessory components in the closed position.

3. The band accessory of claim 2, wherein the means for interlocking includes an upper track groove formed in the second upper strip of the second accessory component, and an upper rail formed on a bottom surface of the first upper strip of the first accessory component, the upper rail being sized and shaped to slidably engage the upper track groove.

4. The band accessory of claim 3, wherein the means for interlocking further includes a lower track groove formed in a bottom surface of the first lower strip of the first accessory component, and a lower rail formed on a top surface of the second lower strip of the second accessory component, the lower rail being sized and shaped to slidably engage the lower track groove.

5. The band accessory of claim 4, wherein the at least one magnet includes a top pair of magnets which are disposed on a top surface of the second upper strip of the second accessory component, on opposite sides of the upper track groove.

6. The band accessory of claim 5, wherein the at least one magnet further includes a bottom pair of magnets which are disposed on a top surface of the second lower strip of the second accessory component, on opposite sides of the lower rail.

7. The band accessory of claim 6, wherein the at least one magnet further includes an upper pair of magnets which are disposed on the bottom surface of the first upper strip of the first accessory component, on opposite sides of the upper rail.

8. The band accessory of claim 7, wherein the at least one magnet further includes a lower pair of magnets which are disposed on the bottom surface of the first lower strip of the first accessory component, on opposite sides of the lower track groove.

9. The band accessory of claim 2, wherein the first upper strip extends a first distance D1 from the first middle connector strip that is different than a second distance D2 that the first lower strip extends from the first middle connector strip.

10. The band accessory of claim 2, wherein a bottom surface of the second upper strip is spaced a distance W from a top surface of the first lower strip.

11. The band accessory of claim 2, further comprising a means for frictionally engaging the wearable band.

12. The band accessory of claim 11, wherein the means for frictionally engaging the wristband includes a flat spring extending from a proximal end to a distal end, the proximal end being attached to the top surface of the first lower strip such that the distal end is biased away from the top surface of the first lower strip towards a position that is spaced a distance SD from the top surface of the first lower strip.

13. The band accessory of claim 11, wherein the means for frictionally engaging the wearable band includes a resilient sheet sized to be mounted on a top surface of the first lower strip.

14. The band accessory of claim 11, wherein the means for frictionally engaging the wristband includes a pair of prongs extending from the second accessory component for abutting the wearable band.

15. The band accessory of claim 2, wherein the decorative feature includes text etched or embossed into the top surface.

16. A band accessory for attachment to a wearable band, comprising:

a first accessory component having a first upper strip and a first lower strip that are laterally spaced by a first middle connector strip such that the first upper strip and the first lower strip are positioned substantially parallel to each other;

the first upper strip having a top surface that includes a decorative feature;

a second accessory component having a second upper strip and a second lower strip that are laterally spaced by a second middle connector strip such that the second upper strip and the second lower strip are positioned substantially parallel to each other;

an upper track groove formed in the second upper strip of the second accessory component, and a upper rail formed on a bottom surface of the first upper strip of the first accessory component, the upper rail being sized and shaped to slidably engage the upper track groove such that the first and second accessory components are able to slide longitudinally between an open position wherein the first and second accessory components are separate from each other, and a closed position wherein the first and second accessory components together form an annular shape that is adapted to surround the wearable band so that the decorative feature is displayed on the wearable band; and at least one magnet on the first and/or second accessory components, for securing the first and second accessory components in the closed position.

* * * * *